US005593544A

United States Patent [19]

Fahlgren et al.

[11] Patent Number: 5,593,544

[45] Date of Patent: Jan. 14, 1997

[54] PULP PRODUCTION

[75] Inventors: Christer Fahlgren; Sören Gustavsson, both of Karlstad; Petter Tibbling, Vålberg; Ewa W. Johansson, Kil, all of Sweden

[73] Assignee: Kvaerner Pulping Aktiebolag, Karlstad, Sweden

[21] Appl. No.: 224,711

[22] Filed: Apr. 8, 1994

[30] Foreign Application Priority Data

Jul. 12, 1993 [SE] Sweden ..... 9302409

[51] Int. Cl.[6] ..... D21C 1/04; D21C 3/00

[52] U.S. Cl. ..... 162/65; 162/19; 162/41; 162/37; 162/76; 162/60

[58] Field of Search ..... 162/41, 72, 76, 162/60, 65, 19, 37

[56] References Cited

U.S. PATENT DOCUMENTS

| | | | |
|---|---|---|---|
| 3,652,385 | 3/1972 | Noreus et al. | 162/23 |
| 3,652,386 | 3/1972 | Noreus et al. | 162/65 |
| 4,045,280 | 8/1977 | Mackie | 162/65 |
| 4,091,749 | 5/1978 | Procter et al. | 162/25 |
| 4,826,567 | 5/1989 | Gratzl | 162/72 |
| 5,143,581 | 8/1992 | Devic | 162/72 |
| 5,183,535 | 2/1993 | Tikka | 162/19 |

FOREIGN PATENT DOCUMENTS

| | | | |
|---|---|---|---|
| 0476230A2 | 3/1992 | European Pat. Off. | D21C 3/02 |

*Primary Examiner*—Donald E. Czaja
*Assistant Examiner*—Jose A. Fortuna
*Attorney, Agent, or Firm*—Cushman Darby & Cushman IP Group of Pillsbury Madison & Sutro LLP

[57] ABSTRACT

A method of manufacturing chemical pulp out of comminuted cellulosic fiber material comprising digesting the fiber material with digestion liquid without preceding peroxide stage. According to the invention the comminuted fiber material is treated in at least one stage prior to said digestion, in the presence of a liquid containing at least one compound having the ability to form complexes with metals existing naturally in the fiber material.

33 Claims, 2 Drawing Sheets

PULP PRODUCTION

FIELD OF THE INVENTION

The present invention relates to a method of manufacturing chemical pulp out of comminuted cellulosic fiber material, comprising digesting the fiber material with digestion liquid, said method excluding any peroxide stage before said digesting. The invention relates particularly to a method of the kind described, that gives improved properties with respect primarily to tearing resistance, viscosity and yield.

The object of the invention is to produce a chemical pulp which, already after the digestion process, has considerably reduced content of transition metals and at the same time considerably improved properties with regard especially but not exclusively to tearing resistance, viscosity, yield, kappa number and brightness.

BACKGROUND AND SUMMARY OF THE INVENTION

The method according to the invention is substantially characterised in that the comminuted fiber material is treated in at least one stage prior to said digestion, in the presence of a liquid containing at least one compound having the ability to form complexes together with metals existing naturally in the fiber material. Thus, the treatment with sequestering agent is carried out immediately prior to a pre-impregnation of the chips, for instance, or alternatively during, i.e. simultaneously with the pre-impregnation usually performed before digestion. Treatment with the sequestering agent added is performed so that a pulp is obtained after said digestion process which pulp, besides having a lower content of metals, primarily manganese, has a tearing resistance at least 10% higher, a viscosity at least 5% higher, and produces a yield at least 1% higher than corresponding parameters for a pulp manufactured without said pre-treatment with sequestering agent, calculated within the same kappa number interval.

The invention is applicable to any method whatsoever for manufacturing chemical pulp. A chemical pulp is defined as a pulp having a kappa number below about 100. Such pulps include sulphite and bisulphite pulps based on sodium, potassium or magnesium, alkaline neutral sulphite pulp, pulps of anthraquinone plus hydroxide (NaOH/KOH) or carbonate ($Na_2CO_3/K_2CO_3$) plus possibly oxygen gas, polysulphide pulp, sulphate pulp and pulp produced by pre-impregnating wood with hydrogen sulphide before alkaline delignification, and also pulps produced by delignification of wood with organic solvent such as methanol, ethanol, possibly in the presence of inorganic solvent.

The compound able to form complexes with metals in the fiber material is suitably selected from the group consisting of non-nitrogenous polycarboxylic acids, nitrogenous polycarboxylic acids and phosphonic acids. Diethylene triamine pentacetic acid (DTPA), ethylene diamine tetracetic acid (EDTA) or nitrilo triacetic acid (NTA) are preferred from the first category, oxalic, citric or tartaric acid from the second category, and diethylene triamine pentaphosphoric acid from the third category. Most preferred are EDTA and DTPA. Two or more of the compounds may also be used, and in any combination whatsoever.

The treatment with sequestering agent is suitably performed at a pH value above about 5.0 and at a liquid/fiber material ratio greater than 2:1, preferably greater than 3:1. According to a suitable embodiment said treatment is performed at a temperature of at least 80° C., preferably at least 100° C., a pressure of at least 2 bar, preferably at least 5 bar, most preferably at least 10 bar, and over a period of at least 20 minutes, preferably at least 40 minutes, most preferably at least 60 minutes.

The sequestering agent is supplied in a quantity suitably within the interval 0.5–10 kg per ton of dry fiber material, preferably 1.5–5 kg and most preferably 2–4 kg per ton of dry fiber material.

A separate treatment vessel may be used for the treatment of the wood with sequestering agent, said vessel being located before, i.e. upstream of the digester tank. The treatment according to the invention may be included with the digestion in a continuous process or a discontinuous process for pulp production. The invention is applicable to all types of continuous and discontinuous digestion methods for the manufacture of chemical pulp.

According to one embodiment of the invention at least a considerable portion of free liquid containing metal complexes formed by said treatment is removed from the wood upon completion of the treatment with sequestering agent. This can be achieved by draining, i.e. thickening, and subsequent washing of the wood with a liquid free from metals or having low metal content. The liquid containing metal complexes is preferably removed by being displaced by cleaner liquid of the type described. The liquid removed is transferred directly to an evaporation system. Alternatively the formed metal complexes are permitted to accompany the fiber material into the digestion process.

At least a part of said liquid present during treatment of the fiber material and containing the sequestering agent, consists of spent liquor, fresh digestion liquid, effluent from bleaching processes, condensation, mains water or lake water, or mixtures thereof. The spent liquor used is suitably the spent liquor having reduced, low content of metals that is obtained at said digestion following said treatment with sequestering agent.

Generally the digestion process includes a pre-impregnation of the wood with digestion liquid and/or spent liquor and according to one embodiment of the invention, the treatment with sequestering agent is performed prior to said pre-impregnation and is followed by a washing stage of suitable type as described above. According to another embodiment the treatment with sequestering agent is performed in combination with the actual pre-impregnation as an integrated treatment, in which case the sequestering agent is preferably added together with the impregnation liquid. In this case the metal complexes formed, together with any excess of sequestering agent remaining, accompany the wood to the digestion zone(s) and are not therefore removed before digestion, but at a later stage when the spent liquor is withdrawn. In certain cases the impregnation phase may be relatively short, such as down to about 1 minute, during which brief period treatment with sequestering agent is performed before the digestion phase is started in the continuous process.

Said spent liquor may be black liquor received from the digestion of wood that has been treated with sequestering agent in accordance with one of the alternatives described above. The cooking liquid may be fresh white liquor.

The treatment with sequestering agent may be most advantageously performed in conjunction with an isothermal cooking process that includes a final extended displacement step in which the operating conditions correspond, or substantially correspond, to those prevailing in the preceding digestion zone(s).

The pulp is delignified with oxygen gas after the digestion process. The pulp is suitably treated with sequestering agent immediately prior to the delignification with oxygen gas. The pulp delignified with oxygen gas may then suitably be bleached with a bleaching agent containing hydrogen peroxide, possibly in combination with ozone and/or peracetic acid.

BRIEF DESCRIPTION OF THE DRAWINGS

The invention is further explained in the following examples, which are not however intended to limit the application and scope of the invention, and with reference to the accompanying drawings.

DETAILED DESCRIPTION OF THE INVENTION

Figure 1:
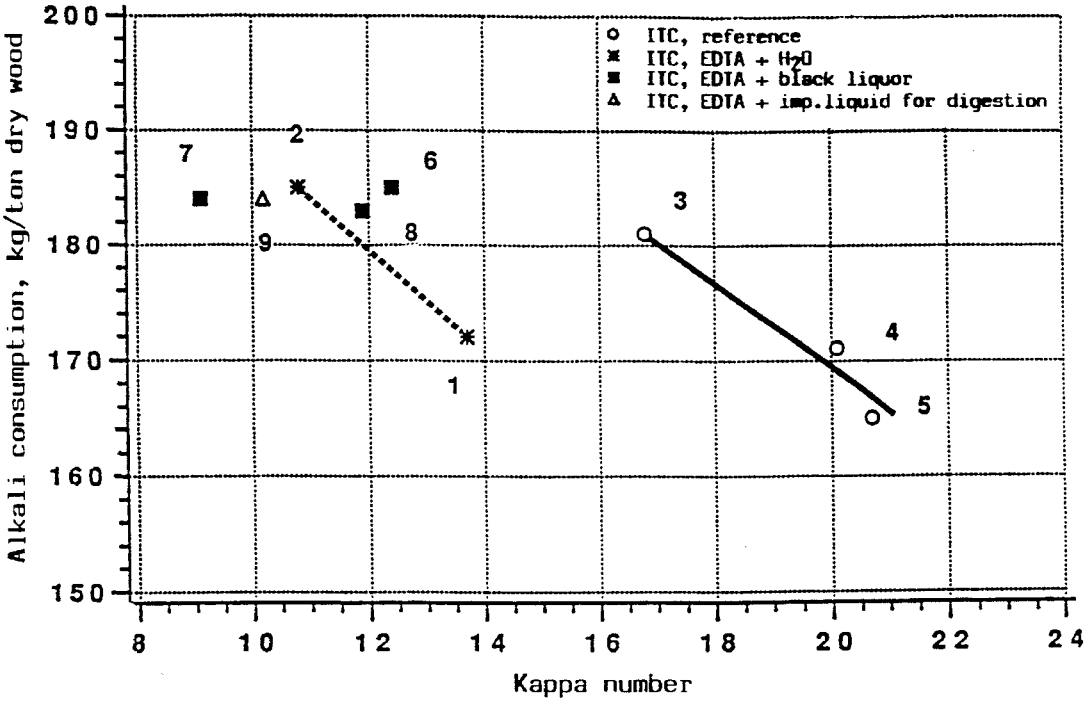
FIG. 1 is a diagram illustrating the alkali consumption as a function of the kappa number.
Figure 2:
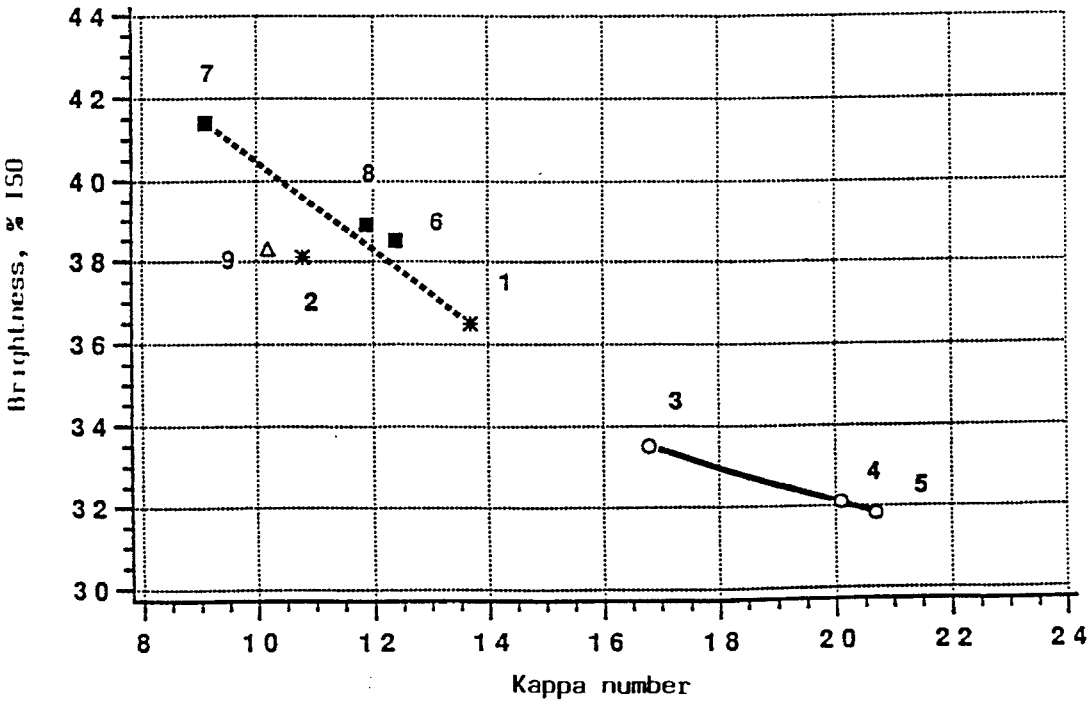
FIG. 2 is a diagram illustrating the brightness as a function of the kappa number.
Figure 3:
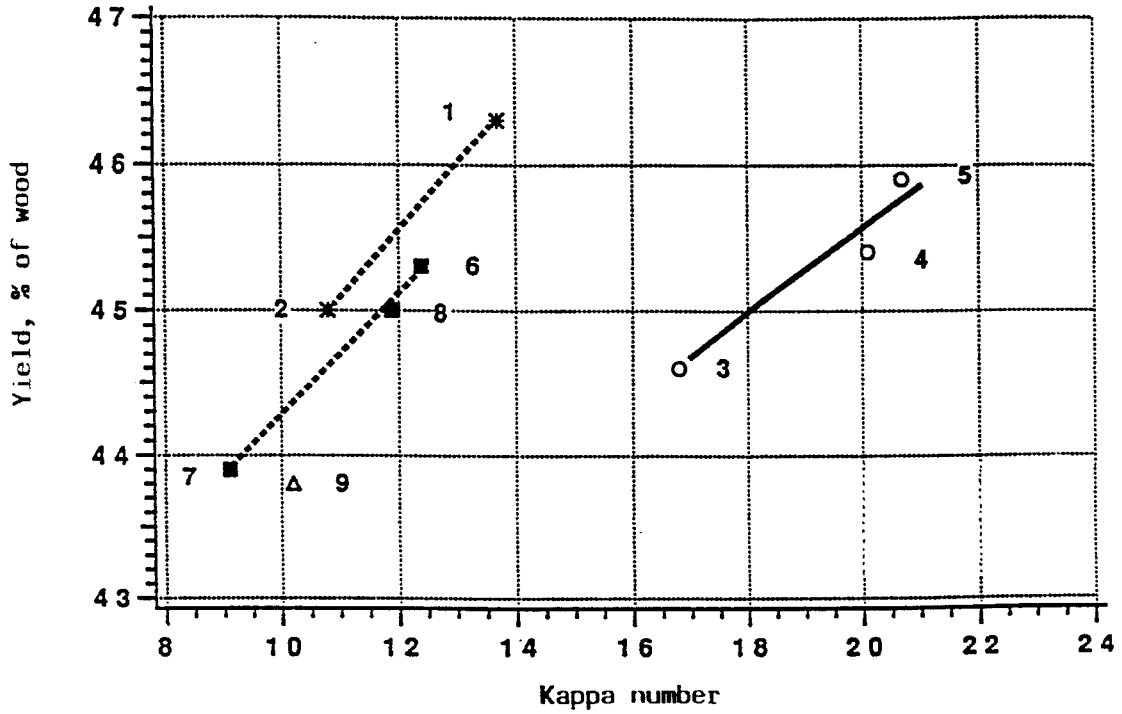
FIG. 3 is a diagram illustrating the yield as a function of the kappa number.
Figure 4:
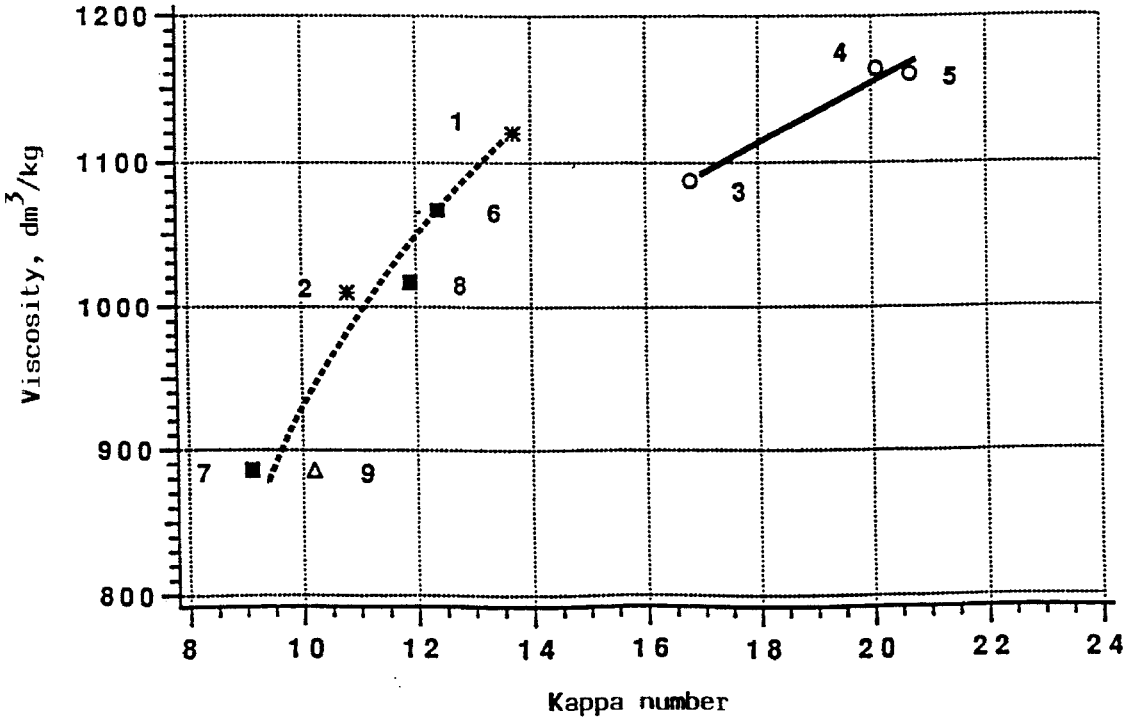
FIG. 4 is a diagram illustrating the viscosity as a function of the kappa number.

In the diagrams shown in the drawings the numbers 1–9 indicate the plotted values from the experiments with the same numbering that are described in the following examples, i.e. the number 1 in the diagram according to FIG. 1 indicates the yield and kappa number values from Experiment 1. The four different symbols are explained in FIG. 1. ITC stands for isothermal cooking which is explained further below.

EXAMPLE

Test 1

Moist chips equivalent to 2.5 kg absolutely dry chips of Scandinavian softwood were treated with steam in a digester with circulation for 5 min. at 110° C. and a pressure of 1.0 bar. The chips contained 220 ppm manganese calculated on the digested pulp at a yield of 45%.

In accordance with the present invention the steamed chips were treated with a sequestering agent dissolved in a liquid. The liquid used was de-ionized water and the sequestering agent used was EDTA in a quantity of 0.005 kg, corresponding to 2.0 kg EDTA per ton of wood. The liquid/wood ratio was 5.5:1. The pH value of the liquid containing EDTA was 6.7. The treatment with EDTA was performed in a digester with circulation for 60 min. at 110° C. and a pressure of 10 bar, the liquid being circulated the whole time. Free liquid was then emptied from the digester in an amount corresponding to 65% of the total content of free and bound liquid. Hot, de-ionized water (without EDTA) was added and allowed to circulate through the digester under steam pressure for 60 min. at a temperature of 110° C. Free liquid is then again emptied from the digester in an amount corresponding to 65% of the total content of liquid.

The chips pre-treated in this way were then subjected to a digestion process of the isothermal cooking type (ITC), preceded by impregnation with digestion liquid in the form of white liquor. The digestion process comprised concurrent digestion, countercurrent digestion displacing black liquor with white liquor, and then an extended displacement phase with white liquor corresponding to the conditions in a "Hi-heat" zone. The white liquor had a sulphidity of 33.2%. At the starting impregnation 140 kg white liquor was used, calculated as effective alkali (EA) per ton of wood. The impregnation was carried out for 30 min. at 125° C. and a pressure of 10 bar (nitrogen gas). At the end of the impregnation the temperature was increased to a digestion temperature of 164° C. and the pressure was gradually reduced to steam pressure. Concurrent digestion was started at said digestion temperature and pressure, the free digestion liquid being caused to circulate through the circulation digester from the top and down for a period of 60 min. Additionally 40 kg white liquor (EA) per ton of wood was added initially during the concurrent digestion. The countercurrent digestion was started upon completion of the concurrent digestion, whereupon 10 liter digester liquid was gradually pumped in and allowed to displace the same amount of black liquor for 60 min. The temperature was maintained constant at 164° C., as well as the liquid/wood ratio, during the time of 60 min. that the countercurrent digestion was in progress. The concentration of white liquor was calculated so that approximately 12 g effective alkali (EA) per liter remained at the end of the countercurrent digestion. The extended displacement phase then followed and took place at the same temperature (164° C.). It commenced with white liquor having a concentration of 10 g effective alkali per liter being added to displace spent liquor out of the circulation digester. 14.4 liter spent liquor was displaced in this way over a period of 180 min. The digested chips were then transferred to a propeller-operated disintegrator to be defibered for 15 min. The yield was determined after washing and thickening the unscreened pulp thus obtained.

Test 2

Test 1 was repeated, the only difference being that the temperature during the digestion process was increased 2° to 166° C. and the amount of white liquor added during the concurrent digestion was increased to 50 kg per ton calculated as effective alkali. The pH value of the liquid containing EDTA was 6.2.

Test 3

Test 1 was repeated for comparison, but the steamed chips were not subjected to any treatment with EDTA. Instead they were digested immediately under the same conditions. The impregnated chips had an effective alkali content of 11.8 g/l.

Test 4

Test 3 was repeated for further comparison, the only difference being that the temperature during the digestion process was lowered 2° to 162° C. The impregnated chips had an effective alkali content of 12.1 g/l.

Test 5

Test 3 was repeated, with the difference that the chips were impregnated with black liquor instead of white liquor, the amount of white liquor being increased to an equivalent extent during the concurrent digestion in order to achieve the necessary content of effective alkali, and that the temperature during the digestion process was lowered 2° to 162° C. The chips impregnated with black liquor contained no effective alkali (pH 10.8).

The results of the five experiments are given in the following Table 1. "Alkali consumption" refers to the totally consumed effective alkali (EA) in kg per ton of wood calculated as absolutely dry.

TABLE 1

| | Invention | | Reference | | |
|---|---|---|---|---|---|
| | Test 1 | Test 2 | Test 3 | Test 4 | Test 5 |
| EDTA, kg/ton wood | 2.0 | 2.0 | 0 | 0 | 0 |
| Digestion temp., °C. | 164 | 166 | 164 | 162 | 162 |
| Alkali consumption | 172 | 182 | 181 | 171 | 168 |
| Yield, % of wood | 46.3 | 45.0 | 44.6 | 45.4 | 45.6 |
| Kappa number | 13.7 | 10.8 | 16.8 | 20.1 | 20.7 |
| Viscosity, $dm^3/kg$ | 1120 | 1010 | 1087 | 1164 | 1160 |
| Brightness, ISO | 36.5 | 38.1 | 33.5 | 32.1 | — |
| Mn, ppm | 31 | 30 | 92 | 107 | — |
| Mg, ppm | 79 | 50 | 377 | 405 | — |
| Ca, ppm | 1043 | 1003 | 1688 | 1805 | — |
| Cu, ppm | 1 | 3 | 54 | 27 | — |
| Fe, ppm | 41 | 25 | 22 | 58 | — |
| Tensile index, kNm/kg | 80 | 80 | — | 80 | 80 |
| Beat revolutions, PFI | 1100 | 1200 | — | 1350 | 1000 |
| Drainage resistance, °SR | 15.5 | 15.5 | — | 15.5 | 15.0 |
| Density, $kg/dm^3$ | 630 | 640 | — | 640 | 630 |
| Air resistance, sec/100 ml | 2.3 | 2.6 | — | 3.5 | 3.3 |
| Burst index, MN/kg | 5.6 | 5.4 | — | 6.1 | 5.9 |
| Tear index, $Nm^2/kg$ | 26.5 | 25.6 | — | 19.1 | 19.7 |

A high tear index is obtained per se with the digestion process including a final extended displacement phase at digestion temperature, known as the ITC technique, used in the tests. This can be seen from the reference Tests 4 and 5. A lower tear index, normally at the level 15–16 $Nm^2/kg$, is obtained without this ITC technique. The pulps produced according to the invention have tear indexes of 26.5 and 25.6 $Nm^2/kg$ at a tensile index of 80 kNm/kg, as compared with 19.1 and 19.7 $Nm^2/kg$ for the reference pulps. This result is very surprising. The difference is in itself surprising but even more surprising is that the difference is so great. Such high tear index values have not previously been measured for pulp made of Scandinavian softwood. Not even Douglas firs, which have the strongest fiber, produce pulps with such high tear index values.

The experiments also show that the pulps according to the invention are just as easily beaten as the reference pulps, and they have the same density despite considerably lower kappa number. The high permeability to air (low air resistance) which indicates good drainage properties in washing equipment for the pulp, is also remarkable. This was confirmed both visually and sensorially since the pulps according to the invention were dewatered extremely easily when being further processed and had the same rugged character as a high yield pulp. This may possibly be the explanation for the negligibly lower burst resistance.

Extrapolation of the yield values obtained to the kappa number interval 12–16 indicates that the pulps according to the invention give 2.5–3.0% higher yield than the reference pulps. 6–7% more pulp can thus be produced from the same quantity of raw material irrespective of whether the pulp is bleached or unbleached.

Extrapolation of the viscosities obtained to the kappa number interval 12–16 indicates that pulps according to the invention show viscosities 150–200 SCAN units ($dm^3/kg$) higher than the reference pulps. Normally a lower viscosity indicates poorer strength properties. The pulps according to the invention surprisingly show a different and higher level for this relationship. The pulp according to Test 2 has a viscosity of 1010 $dm^3/kg$ and a tear index of 25.6 $Nm^2/kg$, as compared with the reference pulps according to Tests 4 and 5 for which the mean value of the viscosity is 1162 $dm^3/kg$, but the tear index is 19.4 $Nm^2/kg$, i.e. the tear index is 32% higher for the invention than for the references, despite lower viscosity. The reject percentage upon screening through 0.15 mm slits was also determined in Test 2 and proved to be below a level of 0.1% of the pulp. For an ITC-pulp this value is usually just below 0.5%.

Extrapolation of the brightness values obtained to the same kappa number shows that the pulps according to the invention are 1.5–2.0 ISO units brighter than the reference pulps.

The mechanisms causing these surprising results are not fully explained. Without being tied to any explanations, however, a decrease in the manganese content probably has at least a certain significance. According to Tests 1 and 2 treatment with sequestering agent (EDTA) enabled a reduction in the manganese content from about 100 ppm (calculated on absolutely dry pulp) to 30 ppm. Manganese reciprocates or alternates between the valency levels +4 ($MnO_2$, pyrolusite) and +6 ($MnO_4$—, green-coloured ion) in a redox cycle continuously generating free radicals (OH·) which break down the carbohydrates in accordance with a known pattern. The process is known as the Haber Weiss cycle and is described in Trieselt W., "Chemistry of catalytic degradation during hydrogen peroxide bleaching", Melliand Textilberichte V51 (1970), page 1094.

EXAMPLE 1

Test 6

Steamed chips according to Example 1 were treated with EDTA dissolved in a liquid, in accordance with the present invention. The liquid used was black liquor obtained from Experiment 2 in Example 1, and was therefore partially freed from manganese. The quantity of EDTA was 0.005 kg, and this was mixed with about 9 liter black liquor. The liquid/wood ratio was 5.5:1. The pH value of the black liquor containing EDTA was 10.3. The treatment with EDTA was performed in a circulation digester for 60 min. at 110° C. and a pressure of 10 bar, the black liquor being circulated the whole time. Free liquid was then emptied from the digester in an amount corresponding to 65% of the total content of free and bound liquid. 9 liter of the same black liquor was added and allowed to circulate for another 60 min. at an increased temperature of 125° C. and a pressure of 10 bar. Free liquid was then emptied from the digester in a quantity corresponding to 65% of the total amount of liquid.

After the pre-treatment with EDTA 120 kg white liquor per ton wood was added, calculated as effective alkali, after which the chips were digested in accordance with Test 1 in Example 1.

Test 7

Test 6 was repeated, the only difference being that the temperature during the digestion process was increased 3° to 167° C. The pH value of the black liquor containing EDTA was 10.7.

Test 8

Test 6 was repeated with the difference that the treatment with EDTA in black liquor was continued for 25 min. instead of 60 min. and subsequent washing with black liquor for 20 min. instead of 60 min., and that the temperature during the digestion process was 165° C. The pH value of the black liquor containing EDTA was 11.3.

The results of the three experiments are given in the following Table 2.

TABLE 2

| | Test 6 | Test 7 | Test 8 |
|---|---|---|---|
| EDTA, kg/ton wood | 2.0 | 2.0 | 2.0 |
| Digestion temp., °C. | 164 | 167 | 165 |
| Alkali consumption | 185 | 184 | 183 |
| Yield, % of wood | 45.3 | 43.9 | 45.0 |
| Kappa number | 12.4 | 9.1 | 11.9 |
| Viscosity, $dm^3/kg$ | 1067 | 886 | 1017 |
| Brightness, ISO | 38.5 | 41.4 | 38.9 |
| Mn, ppm | 49 | 54 | 73 |
| Mg, ppm | 80 | 92 | 149 |
| Ca, ppm | 587 | 783 | 838 |
| Cu, ppm | 10 | 13 | 17 |
| Fe, ppm | 28 | 26 | 27 |
| Tensile index, kNm/kg | 80 | 80 | 80 |
| Beat revolutions, PFI | 1100 | 1500 | 800 |
| Drainage resistance, °SR | 15 | 16 | 15 |
| Density, $kg/dm^3$ | 620 | 630 | 630 |
| Air resistance, sec/100 ml | 2.2 | 2.7 | 3.0 |
| Burst index, MN/kg | 5.4 | 5.3 | 5.8 |
| Tear index, $Nm^2/kg$ | 27.3 | 26.6 | 21.4 |

Although black liquor (with metals partially removed) was used as liquid in the EDTA treatment and the digestion was carried out so that still lower kappa numbers were obtained, the tearing resistance in Tests 6 and 7 was increased even more than in the pulps according to Tests 1 and 2. A tendency towards slightly greater need for beating of a pulp with kappa number 9.1 according to Test 7 can possibly be discerned. Other mechanical properties of the pulps according to this example are substantially the same as for the pulps according to Tests 1 and 2.

At the same kappa number Tests 6–8 gave digestion pulps with almost the same high yield as Tests 1 and 2.

The viscosity and brightness were also on the same levels as for the pulps according to Tests 1 and 2.

It is remarkable that, despite the higher content of manganese in Test 6, namely 49 ppm, a somewhat higher tearing resistance was obtained than with the digestion pulps according to Tests 1 and 2, the latter having manganese contents of 31 and 30 ppm, respectively. This indicates that treatment with a sequestering agent in accordance with the present invention has a surprising effect in addition to that derived from the formation of complexes and displacement to reduce the metal content in the wood.

Test 9

Steamed chips according to Example 1 were treated with 2.0 kg EDTA per ton of wood, in accordance with the present invention. EDTA was mixed with 140 kg white liquor, calculated as effective alkali, per ton of wood and the white liquor containing EDTA was supplied to the circulation digester for pre-impregnation of the chips under the same conditions as in Test 1, except that at the end of the impregnation the temperature was increased to 167° C. Thereafter digestion of the ITC type was performed in accordance with Test 1, but at said higher digestion temperature of 167° C. Thus in this experiment no EDTA metal complexes were removed before the digestion.

The results are given in the following Table 3.

TABLE 3

| | Test 9 |
|---|---|
| EDTA, kg/ton wood | 2.0 |
| Digestion temp., °C. | 167 |
| Alkali consumption | 184 |
| Yield, % of wood | 43.8 |
| Kappa number | 10.2 |
| Viscosity, $dm^3/kg$ | 886 |
| Brightness, ISO | 38.3 |
| Mn, ppm | 50 |
| Mg, ppm | 245 |
| Ca, ppm | 1290 |
| Cu, ppm | 38 |
| Fe, ppm | 20 |
| Tensile index, kNm/kg | 80 |
| Beat revolutions, PFI | 2300 |
| Drainage resistance, °SR | 15.5 |
| Density, $kg/dm^3$ | 660 |
| Air resistance, sec/100 ml | 3.5 |
| Burst index, MN/kg | 6.1 |
| Tear index, $Nm^2/kg$ | 24.5 |

As is clear from the above results, the tearing resistance of also this pulp shows a considerable improvement over the reference pulps according to Tests 4 and 5, as well as being clearly better than the reference pulps in other respects, within the same kappa number interval. The results must be deemed surprising also in view of the fact that no withdrawal of liquid containing metals was performed.

As is evident, the manganese content in the pulp has been halved as compared with the reference experiments.

Test 10

The pulp obtained from Test 1 was subjected to delignification with oxygen gas supplied in excess. In each delignification 100 g pulp, calculated as absolutely dry, was supplied to an autoclave and varying quantities of NaOH were added. The pulp had a consistency of 10%. Delignification was carried out at a temperature of 105° C. and a pressure of 5 bar over a period of 60 min.

Test 11

Test 10 was repeated with the exception that treatment with EDTA was performed before the oxygen gas treatment. 2.0 kg EDTA per ton dry pulp was allowed to act on the pulp with a consistency of 10% for 60 min. at a temperature of 70° C. The final pH value was 5.0. The pulp was then treated with oxygen gas as in Experiment 10.

Test 12

The pulp obtained from Test 4 was subjected to delignification with oxygen gas in the same way as in Test 10.

The results of the three experiments are given in the following Table 4.

TABLE 4

| | Invention | | | | | | Reference | | |
|---|---|---|---|---|---|---|---|---|---|
| | Test 10 | | | Test 11 | | | Test 12 | | |
| | A | B | C | A | B | C | A | B | C |
| Kappa number | 13.7 | 13.7 | 13.7 | 13.7 | 13.7 | 13.7 | 20.1 | 20.1 | 20.1 |
| Viscosity, $dm^3/kg$ | 1120 | 1120 | 1120 | 1120 | 1120 | 1120 | 1164 | 1164 | 1164 |
| O-stage | 0 | 0 | 0 | 2.0 | 2.0 | 2.0 | 0 | 0 | 0 |
| EDTA, kg/ton wood | | | | | | | | | |
| $O_2$-stage | | | | | | | | | |
| NaOH, kg/ton wood | 15 | 20 | 25 | 15 | 20 | 25 | 15 | 20 | 25 |
| Final pH | 11.2 | 11.6 | 11.8 | 11.1 | 11.3 | 11.7 | — | — | — |
| Kappa number | 7.6 | 7.1 | 6.9 | 7.3 | 5.6 | 5.7 | 8.6 | 7.7 | 6.8 |
| Viscosity, $dm^3/kg$ | 975 | 961 | 944 | 1029 | 972 | 966 | 980 | 959 | 920 |
| Brightness, % ISO | 44.7 | 45.7 | 48.3 | 49.7 | 54.1 | 54.3 | — | — | — |

As is clear from the above results, pulps with kappa number 6 and viscosity 1000 $dm^3/kg$ can be manufactured from chips that have been EDTA-treated in accordance with the invention. Kappa number 9 is reached with the same viscosity for the reference pulp according to Test 12.

This reduction of the kappa number by 35% enables the production of finally bleached sulphate pulps of softwood with correspondingly reduced quantities of bleaching agent such as chlorine dioxide, ozone and/or hydrogen peroxide.

Thus, the expression "prior to said digestion" means that no treatment with any other chemical such as peroxide is performed after the wood has been treated with sequestering agent. The method according to the invention is thus free from such peroxide treatment before the digestion process, i.e. also before said treatment with sequestering agent. The only additional treatment is that a second stage with sequestering agent may be performed, as well as impregnation of the wood with digestion liquid if the digestion forms part of a process that also includes such impregnation.

We claim:

1. A method of manufacturing chemical pulp out of comminuted cellulosic fiber material comprising digesting the fiber material with digestion liquid, said method excluding any peroxide stage before said digesting, characterized in that the comminuted fiber material is treated in at least one stage prior to said digestion, in the presence of a liquid containing at least one sequestering agent forming complexes with metals existing naturally in the fiber material, said sequestering agent being selected from the group consisting of nitrogenous polycarboxylic acids, non-nitrogenous polycarboxylic acids and phosphoric acids, at least part of said liquid present during treatment of the fiber material and containing sequestering agent, consists of spent liquor, fresh digestion liquid, effluent from bleaching processes, condensate, mains water or lake water or mixtures thereof, said spent liquor having a reduced, low content of metals that is obtained at said digestion following said treatment with a sequestering agent, said digestion being preceded by pre-impregnation of the fiber material with cooking liquid, and said treatment with sequestering agent being performed in combination with the pre-impregnation as an integrated treatment, metal complexes formed during said integrated treatment and any excess of unreacted sequestering agent being permitted to accompany the fiber material into the digestion in order to be removed after the digestion when the cooking liquor is withdrawn.

2. A method as claimed in claim 1, characterized in that the stage with said sequestering agent is performed at a pH value above about 5.0.

3. A method as claimed in claim 1, characterized in that sequestering agent is added to the impregnation liquid supplied to the fiber material.

4. A method as claimed in claim 1, characterized in that the sequestering agent is selected from the group consisting of diethylene triamine pentacetic acid, ethylene diamine tetracetic acid, nitrilo triacetic acid, oxalic acid, citric acid, tartaric acid and diethylene triamine pentaphosphoric acid.

5. The method as claimed in claim 4 characterized in that the sequestering agent used is ethylene diamine tetracetic acid.

6. The method as claimed in claim 4 characterized in that the sequestering agent used is diethylene triamine pentacetic acid and ethylene diamine tetracetic acid.

7. A method as claimed in claim 1, characterized in that the sequestering agent used is diethylene triamine pentacetic acid.

8. A method as claimed in claims 7, characterized in that the treatment with sequestering agent is performed in a separate treatment vessel located upstream of a vessel for the digestion.

9. A method as claimed in claim 8, characterized in that the treatment with sequestering agent and the digestion are included in a continuous pulp production process.

10. A method as claimed in claim 8, characterized in that the treatment with sequestering agent and the digestion are included in a discontinuous pulp production process.

11. A method as claimed in claim 1 or 2, characterized in that the stage with said sequestering agent is performed at a liquid/fiber material ratio greater than 2:1.

12. The method as claimed in claim 11 wherein said temperature is at least 100° C., the pressure is at least 5 bar and the duration of the treatment is at least 40 minutes.

13. The method as claimed in claim 11 wherein the pressure is at least 10 bar and the duration of the treatment is at least 60 minutes.

14. A method as claimed in claim 11 characterized in that the treatment with said sequestering agent is performed at a temperature of at least 80° C., a pressure of at least 2 bar and over a period of at least 20 minutes.

15. A method as claimed in claim 14 characterized in that the sequestering agent is supplied in a quantity within the interval 0.5–10 kg per ton of dry fiber material.

16. The method as claimed in claim 14 wherein the sequestering agent is supplied in a quantity within the interval of 1.5–5 kg per ton of dry fiber material.

17. The method as claimed in claim 14 characterized in that the sequestering agent is supplied in a quantity within the interval of 2–4 kg per ton of dry fiber material.

18. A method of manufacturing chemical pulp out of comminuted cellulosic fiber material comprising the steps of digesting the fiber material with digestion liquid while excluding any peroxide stage before said digesting, the comminuted fiber material being first treated in at least one stage prior to the digestion in the presence of a liquid containing at least one sequestering agent forming complexes with metals existing naturally in the fiber material, with said sequestering agent selected from the group consisting of nitrogenous polycarboxylic acids, non-nitrogenous polycarboxylic acids and phosphoric acids, and is also selected from the group consisting of diethylene triamine pentacetic acid, ethylene diamine tetracetic acid, nitrilo triacetic acid, oxalic acid, citric acid, tartaric acid and diethylene triamine pentaphosphoric acid, said treatment with sequestering agent and the digestion being performed in a discontinuous pulp production process, and the fiber material treated with a sequestering agent being fed directly to the digestion process together with formed metal complexes and any unreacted excess of the sequestering agent.

19. A method of manufacturing chemical pulp out of comminuted cellulosic fiber material comprising digesting the fiber material with digestion liquid, excluding any peroxide stage before the digesting, treating the comminuted fiber material in at least one stage prior to said digesting in the presence of a liquid containing at least one sequestering agent forming complexes with metals existing naturally in the fiber material, said treated fiber material being fed directly to the digestion process together with any formed metal complexes and any unreacted excess of sequestering agent, said pulp production process being discontinuous.

20. A method of manufacturing chemical pulp out of comminuted cellulosic fiber material comprising digesting the fiber material with digestion liquid while excluding any peroxide stage before said digesting, said comminuted fiber material being treated in at least one stage prior to said digesting in the presence of a liquid containing at least one sequestering agent forming complexes with metals existing naturally in the fiber material, said at lest one stage being performed at a pH value above about 5.0, the treatment with a sequestering agent and the digesting being carried out in a discontinuous pulp production process, the fiber material being treated with sequestering agent being fed directly to the digestion process together with any formed metal complexes and any unreacted excess of sequestering agent.

21. A method of manufacturing chemical pulp out of comminuted cellulosic fiber material comprising digesting the fiber material with digestion liquid while excluding any peroxide stage before said digesting, said comminuted fiber material being treated in at least one stage prior to said digesting in the presence of a liquid containing at least one sequestering agent forming complexes with metals existing naturally in the fiber material, said at least one stage being performed at a pH value above about 5.0, the treatment with a sequestering agent and the digesting are carried out in a discontinuous pulp production process, the fiber material being treated with sequestering agent being fed directly to the digestion process together with any formed metal complexes and any unreacted excess of sequestering agent, at least part of the liquid present during treatment of the fiber material and containing sequestering agent comprises one of spent liquor, fresh digestion liquid, effluent from bleaching processes, condensate, main water or lake water or mixtures thereof, wherein said digestion liquid is white liquor and the treatment with sequestering agent is performed in conjunction with an isothermal cooking process that includes a final extended displacement stage in which the operating conditions substantially correspond to those prevailing in the preceding digestion step.

22. A method as claimed in claim 21, characterized in that the pulp is delignified with oxygen gas after the digestion process.

23. A method as claimed in claim 22, characterized in that the pulp is treated with sequestering agent immediately prior to the delignification with oxygen gas.

24. A method as claimed in claim 22, characterized in that the pulp delignified with oxygen gas is bleached with a bleaching agent containing hydrogen peroxide.

25. The method as claimed in claim 24 including the step of combining the hydrogen peroxide with ozone.

26. The method as claimed in claim 24 including the step of combining the hydrogen peroxide with peracetic acid.

27. A method as claimed in claim 18, 20 or 21, characterized in that at least a major portion of free liquid containing formed metal complexes is removed from the fiber material upon completion of the treatment with sequestering agent.

28. A method as claimed in claim 27, characterized in that after said emptying, the fiber material is washed with liquid free from metals or having low metal content.

29. A method as claimed in claim 27, characterized in that said liquid removed from the fiber material after treatment with sequestering agent is transferred directly to an evaporation system.

30. A method as claimed in claim 27, characterized in that said liquid containing metal complexes is removed by being displaced by liquid free from metals or having low metal content.

31. A method as claimed in claim 30, wherein at least most of the liquid removed from the fiber material after treatment with sequestering agent is transferred directly to an evaporation system.

32. A method of manufacturing chemical pulp out of comminuted cellulosic fiber material comprising digesting the fiber material with digestion liquid while excluding any peroxide stage before said digesting, said comminuted fiber material being treated in at least one stage prior to said digesting in the presence of a liquid containing at least one sequestering agent forming complexes with metals existing naturally in the fiber material, said at least one stage being performed at a pH value above about 5.0, the treatment with a sequestering agent and the digesting being carried out in a discontinuous pulp production process, the fiber material being treated with sequestering agent being fed directly to the digestion process together with any formed metal complexes and any unreacted excess of sequestering agent, said digestion process being proceeded by a pre-impregnation of the fiber material with cooking liquid, the treatment with sequestering agent being performed in combination with the pre-impregnation as an integrated treatment, any metal complexes being formed during said integrated treatment and any excess of unreacted sequestering agent being permitted to accompany the fiber material into the digesting process in order to be removed from the digestion process when spent liquor is withdrawn.

33. A method of manufacturing a chemical pulp with improved properties, out of comminuted cellulosic fiber material, said method comprising digesting the fiber material with digestion liquid, without preceding peroxide stage, characterized in that the comminuted fiber material is treated in at least one stage prior to said digestion, with a liquid containing at least one compound having the ability to form complexes with metals existing naturally in the fiber material said sequestering agent being selected from the group consisting of nitrogenous polycarboxylic acids, non-nitrogenous polycarboxylic acids and phosphoric acids, so that a pulp is obtained after said digestion process which pulp, besides having a lower content of metals, particularly manganese, has a tearing strength at least 10% higher, a viscosity at least 5% higher, and produces a yield at least 1% higher than corresponding parameters for a pulp manufactured without said pre-treatment with sequestering agent, calculated within the same kappa number interval.

* * * * *